United States Patent [19]

Scanga et al.

[11] Patent Number: 4,890,759

[45] Date of Patent: Jan. 2, 1990

[54] RETORTABLE CONTAINER WITH EASILY-OPENABLE LID

[75] Inventors: Theodore P. Scanga, Lower Burrell; Matthew P. Kiley, Tarentum; Robert J. Metz, Pittsburgh; Fred R. Schultz, Lower Burrell, all of Pa.

[73] Assignee: Aluminum Company of America, Pittsburgh, Pa.

[21] Appl. No.: 302,016

[22] Filed: Jan. 26, 1989

[51] Int. Cl.[4] ..... B65D 17/34

[52] U.S. Cl. ..... 220/273

[58] Field of Search ..... 220/273, 270, 276, 266

[56] References Cited

U.S. PATENT DOCUMENTS

| | | | |
|---|---|---|---|
| 3,191,797 | 6/1965 | Fraze | 220/54 |
| 3,632,461 | 1/1972 | Gayner et al. | 156/257 |
| 3,747,797 | 7/1973 | Gayner et al. | 220/53 |
| 3,812,002 | 5/1974 | Lurie | 161/119 |
| 4,212,409 | 7/1980 | Jeppsson | 220/276 |
| 4,267,937 | 5/1981 | Piltz et al. | 220/267 |
| 4,332,332 | 6/1982 | Ingemann | 220/276 |
| 4,403,710 | 9/1983 | Hirota et al. | 220/270 |
| 4,428,494 | 1/1984 | Hirota et al. | 220/270 |
| 4,434,908 | 3/1984 | French | 220/276 |
| 4,438,850 | 3/1984 | Kahn | 206/634 |
| 4,448,324 | 5/1984 | Jeppsson et al. | 220/266 |
| 4,465,205 | 8/1984 | Sutch | 220/276 |
| 4,501,375 | 2/1985 | Katsura et al. | 220/270 |
| 4,513,876 | 4/1985 | Buchner | 220/270 |
| 4,533,063 | 8/1985 | Buchner et al. | 220/270 |
| 4,562,936 | 1/1986 | Deflander | 220/268 |
| 4,605,142 | 8/1986 | Itoh et al. | 220/359 |
| 4,712,706 | 12/1987 | Nakata et al. | 220/276 |
| 4,735,336 | 4/1988 | Buchner et al. | 220/270 |

FOREIGN PATENT DOCUMENTS 8800159 1/1988 PCT Int'l Appl. .

*Primary Examiner*—Donald F. Norton
*Attorney, Agent, or Firm*—Gary P. Topolosky

[57] ABSTRACT

An easily-openable container lid made from a laminate material which includes a thick outer thermoplastic layer, a thin intermediate gas barrier layer, preferably of metallic foil, and a heat-sealable inner coating or film layer. A score line extends only partially through the outermost layer of this container lid to define an openable section thereof. The lid is further provided with a pull tab severing laminate material along its score line without delaminating, said tab being affixed to the openable lid section with a hollow, integrally-formed rivet. A retortable container and laminate lid combination is also disclosed.

25 Claims, 4 Drawing Sheets

RETORTABLE CONTAINER WITH EASILY-OPENABLE LID

BACKGROUND OF THE INVENTION

1. Field of the Invention

The present invention relates to an easily-openable container lid made from a composite or laminate material which includes a thick outer thermoplastic carrier layer, an intermediate gas barrier layer and a thin, heat-sealable inner coating or film layer. The invention further relates to a container and lid combination which is capable of maintaining seal integrity during retort processing without delaminating.

The increased popularity of microwavable, prepackaged foods has created formidable challenges for the designers of new food and beverage containers. Certain food containers, for example, must be able to withstand the elevated temperatures associated with hot filling and the still higher temperatures of retort processing. For greater consumer appeal, the lids to these containers should be easily openable while providing substantially total access to the container contents. The ability to stack filled containers atop one another is also advantageous. For added convenience, aesthetically appealing container shapes should enable food contents to be dispensed from the containers in which they are heated. In any event, the materials used to make such containers should be pleasing to touch while also preserving container contents in a safe, sterilized and unspoiled condition. For business reasons, these materials should also be easy to shape and form into desired lid configurations, preferably at the high speeds associated with large quantity production.

TECHNOLOGY REVIEW

It is generally known that certain synthetic resins or plastics are suitable for forming into microwavable cooking containers. Several synthetic resins that remain stable and withstand the elevated temperatures of hot filling and/or retort are known to exist. It is still further known to hermetically seal laminate lids to the aperture or open mouth of a particular container. Heat-sealable lids, some of which include an aluminum foil layer, are usually tougher to peel from their respective containers due to the bond strengths required to maintain such seals. It is also known to provide an aluminum can end with easy-openable features. Aluminum lids increase food and/or beverage packaging costs, however.

In recent years, a number of food containers and container-lid combinations have been disclosed for use in a microwave oven. Still other containers have been provided with laminated lids containing one or more easily-openable features. FIGS. 6 and 7 of Piltz et al U.S. Pat. No. 4,267,937, for example, show a two-pieced lid consisting of an outer injection-molded portion and an inner plastic layer. A discontinuous tearing notch extends into the injection-molded portion and up to the inner plastic layer or shallower. A relatively thick plastic section is integrally formed from the same material as the outermost portion to form a gripping tongue.

In Ingemann U.S. Pat. No. 4,332,332, there is shown a flanged container having a plastic lid heat sealed thereto. A line of weakness, or failure zone, is provided adjacent the inward edge of this container flange. Both lid and container are adapted to permit a lid portion inward of the weakness line to be pushed down a limited distance for fracturing the failure zone. A number of upstanding, stiffening ribs are also provided for lid removal by pulling upwardly on one or more of said ribs.

Hirota et al U.S. Pat. No. 4,403,710 shows a flanged container and heat-sealed, laminated lid. The composite material for this lid consists of an inner resin layer adhesively bonded to an outer layer of aluminum foil. In a second embodiment shown at FIG. 4, the outer foil layer is further covered with a thin resin-protecting layer. A score line extends completely through this resin layer and into the foil inwardly from the portion of the lid to be heat sealed. Score line fracturing and lid removal are then accomplished by manipulation of the opening tab adhesively attached to the foil layer of said lid.

Hirota et al U.S. Pat. No. 4,428,494 shows an easily-openable lid comprising a relatively thick inner thermoplastic layer adhered to a thicker metal foil layer. A thin primer coating is then applied to a portion of the outer foil layer for bonding a tab to its openable portion. For easy removal of this openable lid portion, flat-bottomed score lines are provided which extend through the outer primer coating and at least partially into the metal foil layer.

Kahn U.S. Pat. No. 4,438,850 shows a laminated lid for sealing to the rim of a retortable container body. The lid consists of an inner resin layer adhesively bonded to an outer barrier layer of paper or aluminum foil. An optional printed film may be provided over the outer lid layer. A lid tab extends outwardly from the container body rim. By grasping this tab and lifting it upward, the resin layer tears as the foil layer peels away from the container body. Any resin layer that remains bonded to the container body should then be cut away.

In Jeppsson et al U.S. Pat. No. 4,448,324, there is shown a plastic container lid with an optional metal foil underlayment. The lid has a peripheral flange which fits over the upstanding edge of a container mouth or aperture. A planar central panel of one lid embodiment attaches to this container flange with a weld zone having lower strength than the adjacent panel. An opening tab is adhesively bonded to the central panel adjacent this weld zone. By manipulation of this opening tab, the central panel may be separated and removed from its container.

Katsura et al U.S. Pat. No. 4,501,375 shows a laminated lid heat-sealed to the peripheral flange of a retortable container. The construction material for this lid consists of a heat-sealable inner surface member adhered to a thick metal foil layer and a thin outer resin layer. The score line defining an openable portion of this lid extends to the midway point of the metal foil and thus completely through the outer resin layer. The openable portion of this lid is further provided with an aperture through which a resin-type rivet is inserted for attachment of an opening tab thereto.

In Buchner U.S. Pat. No. 4,513,876, there is shown a container lid consisting of a relatively thick, outer carrier layer of thermoplastic material, a metal barrier layer, preferably of thin metal foil, and an inner sealing layer of thermoplastic material. A heated notching tool entirely, or almost entirely, perforates the outer layer of this lid while weakening the barrier layer at a coinciding point. The weakened line that is heat-formed into this lid defines a tear-open lid section to which a grip tab is heat-sealed, welded or glued.

Buchner et al U.S. Pat. No. 4,533,063 discloses another container lid configuration with an indentation heat-impressed to completely, or nearly completely, penetrate its outermost carrier layer. Gripping tabs or levers are welded to said lid for effecting its removal according to FIGS. 4 and 5.

Various embodiments of another easily-openable lid are shown in Deflander U.S. Pat. No. 4,562,936. Most of these embodiments include optional reclosure means. Within such lids, the rigid outer layer is scored with a weakness line before being bonded to a substantially gas-impermeable intermediate layer and thermoplastic inner layer. The lid at FIGS. 7 through 9 is then further provided with a tape tab adhesively secured to an exposed section of the intermediate layer.

Itoh et al U.S. Pat. No. 4,605,142 shows a flanged resin container having a peelable, heat-sealed lid. The container flange includes an annular upstanding protuberance or ridge having a pair of opposed, outwardly projecting points. According to the reference, this ridge provides better bonding than a flat flanged area. A sealed lid is removed from this container by grasping, lifting and peeling away at one of the outwardly projecting points to said container flange.

Nakata et al U.S. Pat. No. 4,712,706 shows an easy-openable lid construction made from a thick thermoplastic layer which covers a metallic foil surface having an inner resin coating applied thereto. This lid is scored with a heated cutter either to the full depth of its outermost layer or to a shallower depth, such as halfway through said outer thermoplastic layer. The opening tab or tabs for this lid extend along the container sidewalls. Such tab(s) may be integrally formed as part of the lid, itself. Following lid removal, substantially total access is provided to the container contents without interference from any remaining lid overhang.

SUMMARY OF THE INVENTION

It is a principal object of this invention to provide retortable containers with an easily-openable lid made from a plastic-metal-plastic laminate. It is a further object to economically manufacture this lid using well-known or subsequently developed cold-forming techniques.

It is another object to provide retortable container lids from a multilayer composite which includes a thick outer thermoplastic layer, a thin gas barrier layer and an inner coating or film of another thermoplastic. It is still a further object to provide this container lid with a score line that extends only partially through the outermost thermoplastic layer so as to not weaken or otherwise disrupt the gas barrier and inner coating (film) layers. It is still a further object to mechanically induce this score line without the purposeful application of any heat to this lid.

It is still a further object of the invention to provide a multilayer lid construction with opening tabs that are affixed other than through adhesion or hot welding. With the present invention, means are provided for integrally riveting a grip or pull tab to all layers of this laminate lid. Though bubble formation and button riveting are well known for aluminum can ends, it is a principal object to provide a substantially plastic lid construction with similar capabilities.

It is another principal object of this invention to provide an easily-openable lid for a paper, metal, all-plastic or composite container construction. This lid preferably provides substantially total access to an aperture in the container body following its full removal. Easier lid removal is enhanced by scoring to a partial depth immediately adjacent the lid sealing perimeter. In alternative embodiments, the lid score line may spiral inwardly to remove larger openable sections with less effort.

It is a further object to provide a container and lid which may be hot filled and retorted, then heated or warmed in either a conventional or microwave oven. It is another object to provide this container-lid combination with the ability to survive prolonged shelf storage at or below room temperature.

It is still a further object herein to provide a retortable container lid which overcomes the problems of existing lids set forth above.

In accordance with the foregoing objects and advantages, there is disclosed a container lid made from a laminate material which includes a thick outer thermoplastic layer, an intermediate gas barrier layer, preferably consisting of thin metallic foil, and a heat-sealable inner coating (or film) layer. The outer thermoplastic layer to this lid includes a score line which extends only partially therethrough to define an openable lid section. The lid is further provided with tab means for severing this laminate material along its score line without delaminating, said tab means being attached to the openable lid section by a hollow, integrally-formed rivet.

The invention further discloses an easily-openable container capable of withstanding the elevated temperatures associated with retort sterilization. Said container includes a container body having a bottom wall, a plurality of sidewalls extending upwardly from the bottom wall, and a flange extending outwardly from the sidewalls opposite said bottom wall. A laminate lid is adapted for heat-sealing to the container body flange. The lid includes a thick outer polymer layer having a substantially mechanically-induced score line extending only partially therethrough to define an openable lid section, an intermediate metal foil layer and a thin, heat-sealable inner coating (or film) layer. A pull tab is also provided for fracturing and tearing the lid along its score line, said pull tab being affixed to the openable section of said lid by an integrally-formed rivet.

Individual aspects of this invention also represent significant improvements over the art. For easily-openable lids made from a composite material consisting essentially of an outer thermoplastic layer, an intermediate gas barrier layer and an inner thermoplastic layer, one particular improvement provides such lids with a substantially mechanically-induced score line which extends only partially through its outer thermoplastic layer. Beneath the score line of this lid, there is provided an unscored residual area at least about 4 mils (102 microns) thick. On a more preferred basis, these container lids are provided with score line residuals between about 5–7 mils (127–178 microns) thick. Mechanical scoring to such depths preserves the integrity of the lid's gas barrier and inner coating layers while weakening its outer thermoplastic layer so that an openable lid section may be torn away from a filled container with little effort.

It is a further improvement to provide laminate container lids with a pull tab which attaches to the openable lid section by a hollow, integral rivet cold-formed from the same composite material as the lid. An all-plastic container lid is typically too elastic to cold-form into riveting means. After forming, such lids tend to revert back to their earlier shapes. The incorporation of a thin metal foil layer provides lidding stock with sufficient rigidity for cold lid formation, embossing and riveting.

BRIEF DESCRIPTION OF THE DRAWINGS

Further features, other objects and advantages of this invention will become clearer from the following detailed description of the preferred embodiments made with reference to the drawings in which.

DETAILED DESCRIPTION OF THE PREFERRED EMBODIMENTS

Numerous varieties of container shapes and sizes are made possible by the present invention. A first preferred embodiment is shown as a shallow, circularly-shaped dish having a circular lid heat-sealed thereto. A second preferred embodiment is shown as a rectangularly-shaped container lid heat-sealed to a container with a correspondingly-shaped mouth or aperture. Both packages are designed to be retortable, i.e., capable of surviving the elevated temperatures needed to sterilize and at least partially cook a given food product after filling and sealing within the container. It is to be understood, however, that this invention is not limited to only shallow containers, or container-lid combinations with round or rectangular shapes. The retortable container lids of this invention may also be formed into squares, polygons, triangles and ovals, as well as any other known or aesthetically-pleasing configuration. It should also be understood that the invention is not limited to the containment of only food products. Although it is principally directed to making retortable packages for human or pet foods, the invention may also be practiced for making other sterilizable containers, such as those used for storing and transporting certain medical supplies. More deeply drawn containers may also be made from these same laminate materials to hold beer and other beverages.

Figure 1:
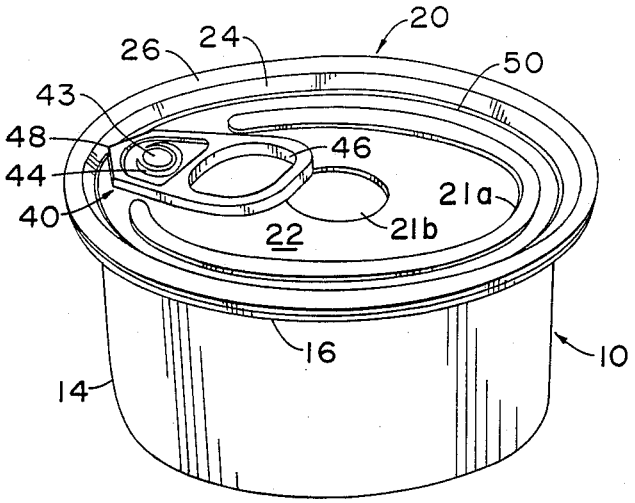
FIG. 1 is a perspective view of one embodiment of lid and container body according to the invention.
Figure 2:
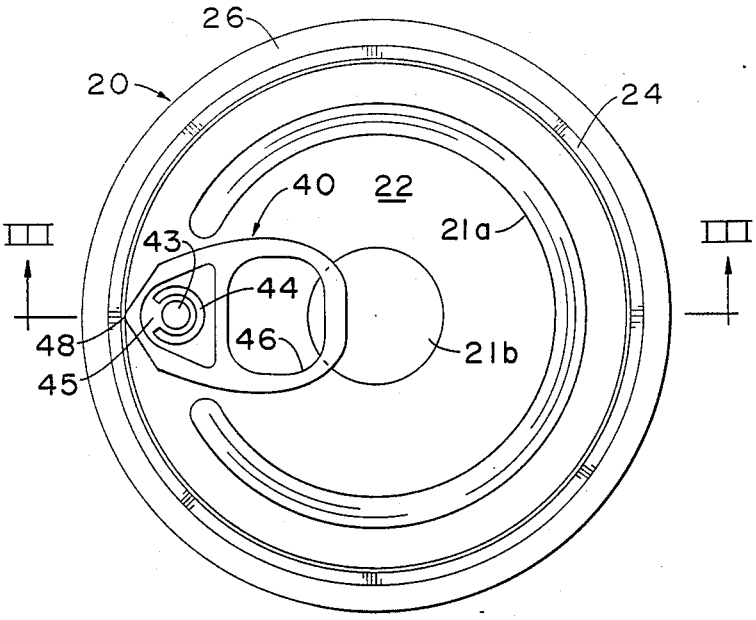
FIG. 2 is a top view of the container lid in FIG. 1.
Figure 3:
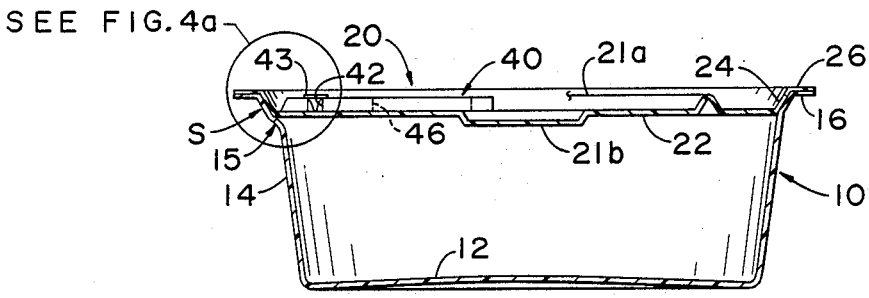
FIG. 3 is a sectional view taken along lines III—III of FIG. 2.

Referring now to FIGS. 1 through 3, there is shown a perspective, top and side view of one retortable container-lid according to the invention. Within this preferred embodiment, container body 10 is shown as a shallow, circularly-shaped dish or package. The container body includes a generally planar bottom wall 12, though it is to be understood that bottom wall 12 may also contain purposeful deformations for improving internal pressure balances, or enhancing container stacking loads. A plurality of sidewalls 14 (illustrated as one continuous curve) extend upwardly from the container bottom wall 12, said sidewalls having a disruption or stepped region 15 for purposes described in greater detail hereinafter. An outwardly extending flange area 16 then emanates from the top of sidewalls 14 opposite bottom wall 12. As shown at FIG. 3, container body 10 does not have a uniformly cylindrical cross section. Rather, sidewalls 14 bevel slightly inwardly, typically between about 4°–20°, due to the drawing, or drawing and ironing, practices used to cold-form container body 10 into its preferred shallow shape. Should deeper, more cylindrical configurations be desired, certain plastic resins may be thermoformed or injection-molded into still other container body shapes.

Numerous materials may be used for making the container body of this invention depending on the product to be contained and the subsequent processing of the container contents. For example, container body 10 may be made from metal foil, one or more synthetic resins or resin blends, and/or mixtures thereof. It is also possible to attach the lids of this invention to containers made from paperboard or paper-containing laminates. For the container shown at FIGS. 1–3, it is preferred that container body 10 be made suitable for retort processing while also being capable of withstanding the higher temperatures associated with heating or warming in a conventional oven. Preferably, container body 10 then consists of at least one synthetic resin which may be formed into the desired shape while also being able to retain its shape after hot filling, retort processing and subsequent heating or warming. Suitable resins for injection-molding or thermoforming into desired container body shapes include polycarbonates (PC), polystyrenes, polyethylenes (PE), polypropylenes (PP) and polyethylene terephthalate (PET). When container bodies are drawn or otherwise cold-worked into shape, it is preferred that they be made from cold-formable plastic-metal laminates similar to those used for the lidstock of this invention. In FIGS. 1 through 5, therefore, the lid and container body 10 are both constructed from the same composite laminate material.

In some embodiments, easily-openable lid 20 is generally planar in cross section. On a more preferred basis, though, lid 20 is embossed with a raised region 21*a* and lowered region 21*b* for taking up any slack in the materials used to make said laminate lid. Raised region 21*a* further serves to locate the lid tab (i.e., prevent it from pivoting about) while rendering filled containers more uniformly stackable by extending at least as high as (or higher than) the top of the tab. The lowered region serves as a recessed area for making gripping of the pull tab easier. Because lid 20 is preferably made from cold-formable laminate materials (described in greater detail hereafter), it may be further provided with beveled edges and/or flaring sidewalls to conform more closely with the mouth or aperture opposite bottom wall 12 of container body 10. The lid 20 illustrated in FIGS. 1 through 3, for example, includes an openable midsection 22 from which a plurality of sidewalls 24 bevel upwardly and outwardly before leveling off to form lid flange 26. As best seen in FIG. 3, lid 20 is purposefully dimensioned to fit snugly within the portion of container body 10 defined by flange area 16. When brought together, the bottom, innermost surface of lid flange 26 contacts with the upper surface to container body flange area 16. The periphery of this entire flange area is then heat-sealed or welded to form a substantially airtight container. Unlike most peelable laminate lids, sealing perimeter S of this invention includes a relatively large, nonplanar area defined by all of sidewall 24 and flange 26.

Figure 4A:
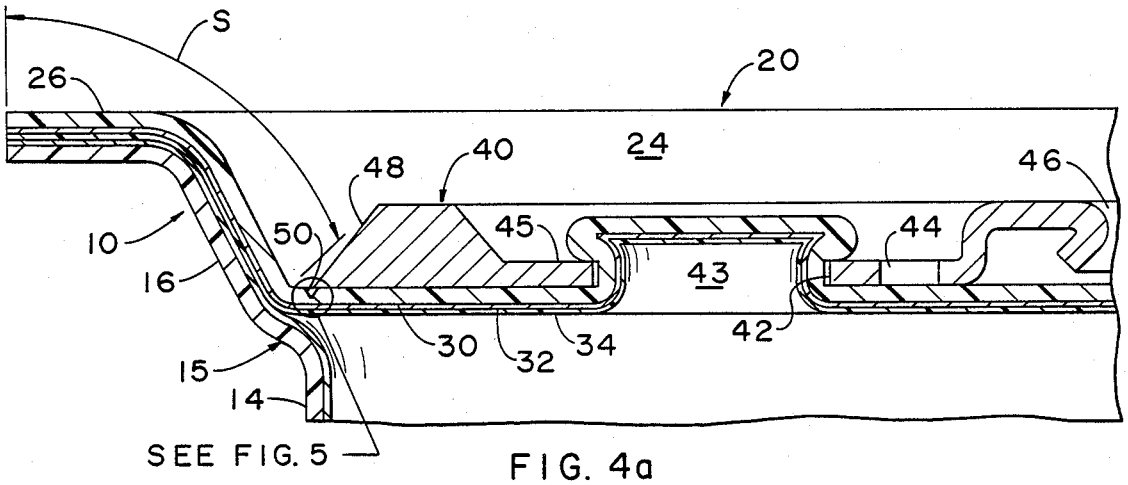
FIG. 4*a* is an exploded view of the circled section from FIG. 3 showing one embodiment of rivet, pull tab and score line in cross section.
Figure 4B:
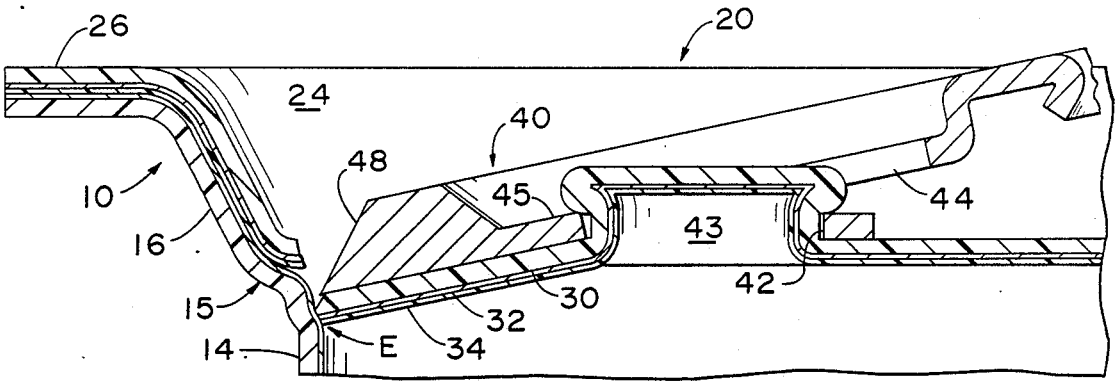
FIG. 4*b* is an exploded view of the same lid section in FIG. 4*a* after the pull tab nose has been lifted to fracture the lid along its score line.
Figure 5:
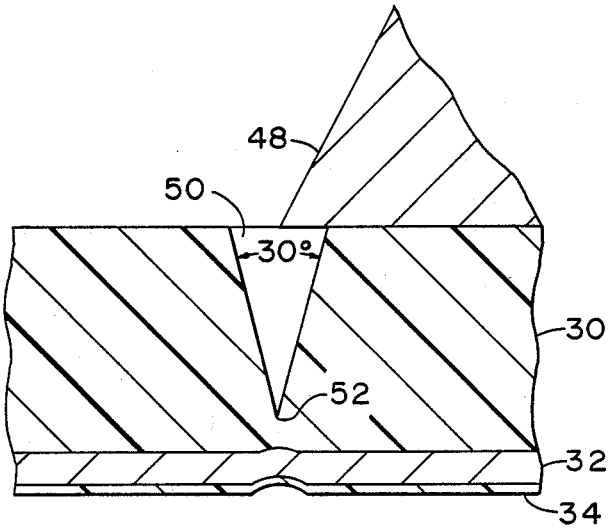
FIG. 5 is an exploded view of a section of score line from FIG. 4*a;*

The laminate or composite material used to manufacture container lids according to one preferred embodiment consists of multiple product layers as better seen in cross section at FIGS. 4*a*, 4*b* and 5. Therein, laminate lid 20 comprises a thick outer thermoplastic carrier layer 30, a thin intermediate gas barrier layer 32 and a heat-sealable inner coating or film layer 34. To promote the adhesion of outer layer 30 to intermediate layer 32, a thin layer of adhesive or primer (not shown) may also be applied therebetween. Suitable laminating adhesives capable of surviving retort sterilization include certain polyurethane or polyester-based adhesives.

Although the laminate lid members of FIGS. 4*a*, 4*b* and 5 are shown with only three layers, it is to be understood that a plurality of sublayers may be substituted for any of the aforementioned. An alternative lid embodiment might thus contain an outer thermoplastic layer 30, a first adhesive layer (not shown), an intermediate foil layer 32 and one or more inner coatings or films 34 applied to either foil layer 32 or an intermediate adhesive/primer layer (not shown).

Each of the three main layers comprising lid 20 serves a particular purpose. Outer thermoplastic layer 30, for example, is the carrier or structural supporting layer for this lid. Because of the relative thickness of outer layer 30 to the other main layers, container lid 20 may be considered to be predominantly thermoplastic. Most known polyolefins are suitable for use in making outer layer 30, provided said resins possess at least some structural rigidity with high heat resistance. On a more preferred basis, outer layer 30 consists essentially of a polyvinyl chloride (PVC), polycarbonate (PC) or polyethylene terephthalate (PET) in crystallized or uncrystallized form. Polypropylenes (PP) suitable for certain retort applications may also be used alone, or in combination (blends) with the foregoing. In terms of relative stiffness, crystalline PET's exhibit more structural rigidity than non-crystalline PET's, which are stiffer than polypropylenes and PVC's, in that order. Colorants may also be blended into the outer layer materials of this lid. Alternatively, outer layer 30 may be made clear so as to reveal the metal foil layer preferably positioned therebeneath. When a clear polymer is substituted for the latter metal foil layer, the entire lid construction could be made transparent to reveal the container contents. In still other embodiments, outer layer 30 may be covered, coated or photogravured with a printed label which may be further protected by an outer coating/film.

On a preferred basis, outer thermoplastic layer 30 of container lid 20 is at least about 8 mils (203 microns) thick. Typically, outer layer thicknesses range from about 10 to 15 mils (254–381 microns) thick. In any event, this outer layer should be at least about five times thicker, or more preferably, between about six to eight times thicker, than the intermediate layer to which it is adhered. Because of these preferred thicknesses, the present container lids are substantially abuse resistant while also being able to withstand the spectrum of temperatures associated with retort processing, shelf storage and low to moderate heating (or warming). Outer carrier layers of this thickness also provide substantial rigidity to the lid construction. Although thicker layers provide greater protection and stiffness, outer layers 30 can also be made too thick. When excess quantities of resin are used, an extremely thick outer-layer becomes too difficult to fracture and/or cleanly tear along its score line.

For the intermediate layer of container lid 20, there exists a plurality of metal foils, thermoplastic resins, or combinations of the same which will suffice as an impermeable gas barrier. Metal foils such as aluminum, steel, tin and iron are used on a more preferred basis since they also provide the lidding stock with at least some degree of cold formability, especially with respect to embossing and hollow rivet formation. The metal or metal alloys comprising intermediate layer 32 should also have high strength properties for providing the laminate material with at least some internal integrity. Exemplary aluminum foils which satisfy the foregoing criteria include 1145, 3003 and 8111 alloys (Aluminum Association designations). Intermediate layer 32 also contributes to the stiffness and structural integrity of lid 20, especially during retort processing. Without the rigidity that a metal foil layer brings, the container lids of this invention would tend to distort at temperatures above about 180°–200° F. Because outer layer 30 operates as the principal carrier for lid 20, however, intermediate layer 32 may be made comparatively thinner, preferably less than about 2 or 3 mils (51–76 microns) thick. On a more preferred basis, intermediate layer consists essentially of an aluminum foil about 1.5 mils (38 microns) thick or less.

As used throughout this detailed description, the thin inner layer 34 of lid 20 has been referred to as either a "coating" or "film" consisting of one or more thermoplastics, said thermoplastics serving to protect the intermediate foil layer from attack by low pH food products (for either human or animal consumption). The difference between these two layer designations is in terms of relative thickness and method of application. An inner "coating" layer may be primed, sprayed, calendered, gravure-applied, or otherwise extruded onto the inner surface of intermediate layer 32 to thicknesses of less than about 1 or 1.5 mils (25–38 microns). Because it may be economically more expedient to provide container lids with a slightly thicker inner layer, the application of one or more protective "films" to the intermediate foil layer, either before or after adhesion to outer layer 30, has also been investigated. From such work, it has been determined that relatively thicker films of certain resins, resin blends or multiple resin layers will also suffice when applied or adhered to the innermost surface of intermediate layer 32. As used throughout the accompanying claims, it is to be understood that the term "coating" covers both thin coatings and thicker coatings, or film applications.

Inner layer 34 prevents the container contents from contacting with the metal foil of intermediate layer 32. A thin coating/film of thermoplastic or polymer thus diminishes the chance that metal foil contact will affect food palatability, smell and/or taste. For this reason, inner layer 34 preferably consists of one or more layers of an FDA-approved, non-absorbing epoxy, polypropylene, polyester, polyethylene, or nylon. On a less preferred basis, when retort processing is not required, inner layer 34 may also contain one or more polyvinyl chlorides. Inner coating layers to lid 20 may also be made from mixtures (or blends) of any of the aforementioned, or from combinations of polymers having a synergistic effect through multiple layering.

The innermost layer(s) to laminate lid 20 also serve a significant sealing function. The material selected for inner layer 34 should possess an ability to strongly adhere, or even weld, to itself or to other container body materials, especially when exposed to the preferred induction sealing procedures described hereinafter. Properly selected inner layer materials should also maintain a high seal integrity following filled container exposure to typical retort temperatures or higher.

Referring again to FIGS. 4*a*, 4*b* and 5, there are shown other novel features of this invention in exploded sectional views. In FIG. 4*a*, for example, pull tab 40 is partially shown in cross section while the container remains closed. FIG. 4*b* shows the same tab in a partially opened position. Tab 40 is preferably made from one or more suitable materials such as aluminum, tin, steel or other metals. In alternative embodiments, opening or pull tabs may also be made from an appropriate rigid plastic or resin blend. In either event, pull tab 40 preferably includes a circularly-shaped first aperture 42 through which extends a hollow, integral rivet 43 made from the same laminate material as the container lid. On a preferred basis, rivet 43 is more specifically formed by making a bubble in this predominantly plastic composite, reforming the bubble into a button, flattening out this button to form a rivet which is internally smooth and resistant to stress cracking. With such preferred tab fastening means, the inner layer 34 of lid 20 within the hollow rivet 43, and adjacent said rivet, remains intact thereby preventing container contents from ever contacting with intermediate layer 32.

First aperture 42 of tab 40 is located inwardly from a second, crescent-shaped aperture 44. A section of tab 40 between the first and second apertures then connects to the remainder of this tab through bridge 45. Said bridge serves as hinging means thereby enabling the tab to be pivoted upwardly without detrimentally affecting rivet 43 during container opening. As shown in FIGS. 4*a* and 4*b*, rivet 43 provides means for attaching or affixing the pull tab 40 to the outer layer 30, intermediate layer 32 and inner layer 34 without piercing, cracking or otherwise disturbing the innermost layers to said lid. Such integral tab fastening means represents a significant improvement to the field of substantially plastic lids. For most of composite lid structures described earlier, opening/pull tabs were either glued or hot-welded to only the outermost layers of a lid or to a purposefully-exposed section of intermediate foil layer. As such, the relative adhesive strengths between pull tab and lid; container body and lid; and between composite layers of said lid were of greater concern to these lid manufacturers.

To prevent tab 40 from pivoting around rivet 43, preferred lid embodiments of this invention further include an embossed ridge or raised region 21*a* extending close to the perimeter of openable lid section 22. Raised region 21*a* further serves as means for making filled containers more easily stackable since this particular embossed area extends at least as high as, if not higher than, the uppermost surface of tab 40. With such an arrangement, the bottommost surface of an adjacent container should rest flatly on the top of raised region 21*a* without interference from the unevenness of tab 40.

Pull tab 40 includes a third aperture 46 for gripping the tab end opposite rivet 43 with a finger or other tab opening object. For facilitating tab gripping and container opening, aperture 46 is preferably located at least partially over an embossed recess or lower region 21*b*. When this second aperture 46, or finger ring, is pivoted upwardly and away from the outermost surface of lid 20, a pointed nose section 48 of tab 40 hinges at bridge 45 to depress into the container for initiating severance along score line 50 without causing the lid to delaminate. Container opening according to preferred embodiments is shown in greater detail in accompanying FIGS. 4*a* and 4*b*. Before opening, nose section 48 extends about midway over score line 50. Once tab 40 is pivoted upwardly, nose section 48 causes a clean fracture and partial tear along this score line. The preferred degree of nose section overlap with score line 50 is not critical to the present invention, however. Other extents of nose tab overlap (or no overlap at all) may also be preferred depending on overall tab shape, attachment and positioning relative to the score.

FIG. 4*b* shows another important advantage of the present invention. When lid 20 is heat sealed to a container body made from the same laminate material as the lid (a polymer-foil-polymer composite) or from one or more polymers/polymer blends, score line 50 may be positioned immediately adjacent the lid's sealing perimeter S to provide substantially total access to the container contents following removal of openable lid section 22. By "substantially total access", it is meant that no more than about 0.03 inch (0.008 mm) of lid lip will remain to overhang the aperture of container body 10, or extend beyond stepped region 15. With less lid lip overhang, the likelihood that a container user or handler will cut or otherwise injure himself on an exposed sharp edge reduces significantly. For mostly polymer container bodies, the materials selected should contain at least some degree of flexibility for allowing stepped region 15 to distort slightly outwardly so that severed edge E of lid 20 and adjoining tab nose section 48 may pass by when tab 40 is first pulled upwardly. A substantially metal container body will not exhibit a similar degree of distortability in this same region. Should the lid of this invention be heat sealed to an all-plastic container body with high elasticity, stepped region 15 will not only bend outwardly to allow lid edge E to pass, it will also spring back or revert to its original shape promptly thereafter. Preferred embodiments of this invention position score line 50 as close to sealing perimeter S as possible without detrimentally affecting the seal between lid 20 and container body 10.

FIG. 5 provides a more detailed view of the improved score line for this invention. Therein, the depth of score line 50 is shown as never exceeding about 75–85% of the total thickness of outer layer 30. When mechanically scoring to only this depth, the relative thicknesses f intermediate layer 32 and inner layer 34 may be significantly reduced provided a residual area at least about 3 mils (76 microns) thick remains beneath the score. Preferably, the relative thickness of unscored residual for this container lid ranges from about 4 to 8 mils (102–203 microns), or more preferably, between about 5–7 mils (127–178 microns). Scoring to this extent still adequately protects both inner layers from dents, disruptions or other handling/packaging abuses. Because the innermost point 52 of score line 50 is sufficiently spaced from intermediate layer 32, the present invention may also use relatively thinner layers of metal foil for gas barrier protection. Only partial scoring of the outer layer 30 also causes less wear and tear on the scoring equipment since no metal surfaces are repeatedly contacted with such tools.

On a more preferred basis, score line 50 is induced partially through outer layer 30 by substantially mechanical means. Unlike the existing container lids described above, it is not necessary to apply heat to the scoring knife or die employed to make score line 50. The only heat that may be present results from the friction associated with substantially continuous use of the scoring tool, itself. Lid scoring may be laser or ultrasonically enhanced, however. On a more preferred basis, it may be possible to combine scoring steps with one or more cold-forming and/or sealing practices.

The preferred scoring tool (not shown) used to cut or stamp score line 50 into lid 20 includes a sharply pointed edge. With such an edge, only slight amounts of plastic on either side of the score are displaced upwardly and outwardly, thereby enabling the laminate member to maintain a substantially planar appearance, not offset relative to the remainder of the lid, adjacent both sides of score line 50. It has been determined that sharply-pointed scoring tools also cause less material compaction and induced stress than would be caused if scoring with the flattened V-shaped tools typically used on aluminum can ends. A sharply pointed tool, nevertheless, causes intermediate layer 32 and inner coating layer 34 to thin to some extent below point 52, as best seen in FIG. 5. The angle of inclination for the point to this scoring tool should range from about 10° to 50°. On a more preferred basis, this scoring tool point is angled between about 20° and 30°.

The score lines mechanically induced into the container lids of this invention may assume several different shapes. Score line 50 in FIG. 2, for example, extends continuously adjacent sealing parameter S, or as close to perimeter S as possible. Alternatively, containers may be provided with score lines that surround the same container perimeter while further spiraling inwardly, said spiraling tending to require less effort for separating smaller widths of lid sections from a container body.

Figure 6:
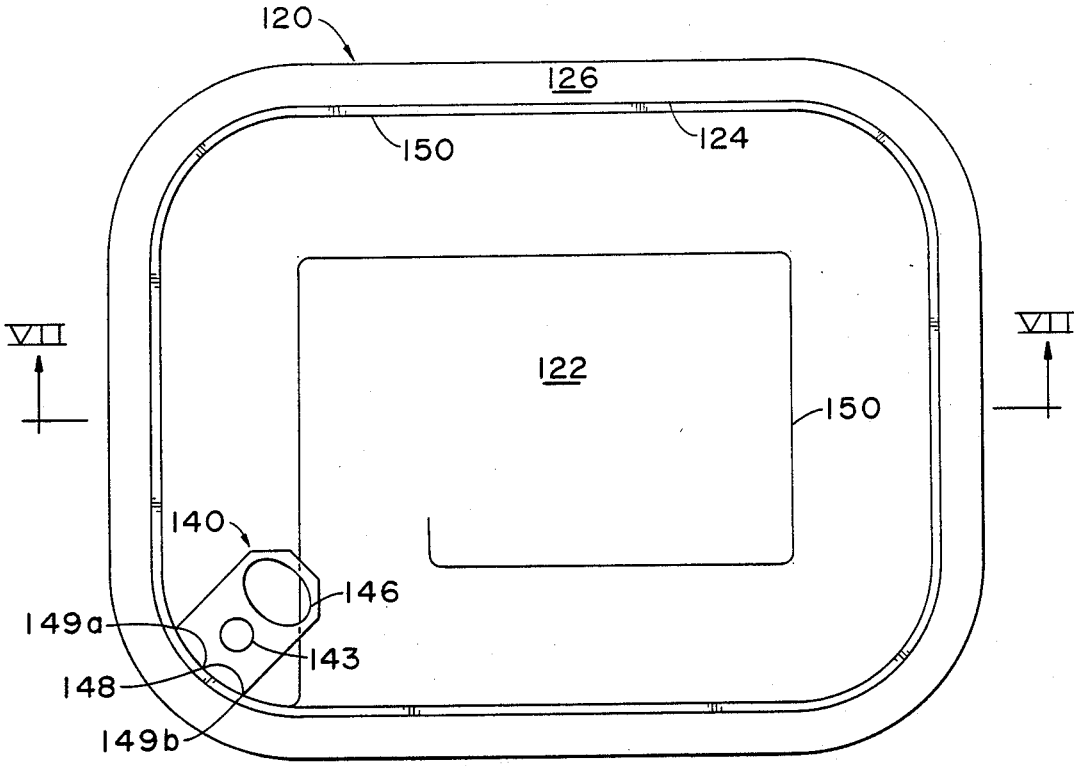
FIG. 6 is a top view of another embodiment of laminate lid heat sealed to a thermoformed container body.
Figure 7:
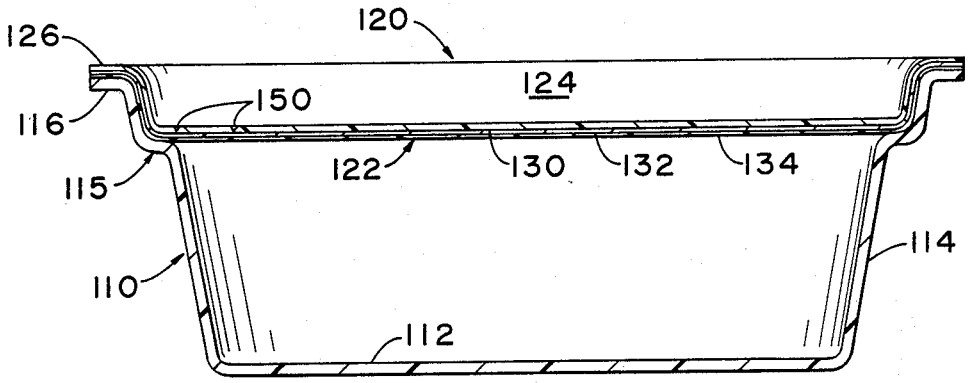
FIG. 7 is a sectional view taken along lines VII—VII of FIG. 6.

Referring now to FIGS. 6 and 7, there is shown a substantially rectangularly-shaped container and lid embodiment according to the invention. In these two illustrations, features similar to those in FIGS. 1 through 5 are correspondingly numbered in the next hundred series. Hence, the container body 110 of FIG. 7 includes a planar bottom wall 112, plurality of sidewalls 114, a stepped region 115 and multilevel flange 116 extending outwardly from sidewalls 114. The container body 110 of FIG. 7 was thermoformed from a single polymer material. It is to be understood, however, that this same container body could be cold-formed, injection-molded or otherwise produced from similar materials and/or laminates to those set forth hereinabove.

The lid component 120 for container body 110 consists of a substantially planar openable midsection 122 (with no raised or lowered regions), together with a lid sidewall 124 and flange area 126 for heat-sealing to the outer periphery of container body flange 116. Lids for this embodiment may also be designed without a flange area for sealing against only the lateral edges of flange 116. The laminate member comprising lid 120, nevertheless, includes a thick outer thermoplastic layer 130, an intermediate foil layer 132 and inner coating or film layer 134. The pull tab 140 affixed to the midsection 122 of this lid by way of integral rivet 143 resembles its earlier counterpart, except that tab 140 includes supplemental end points **149*a* and 149*b* in addition to pointed nose section 148 for fracturing the lid along multiple points of score line 150. As noted previously, the score for this alternative embodiment spirals inwardly from the sealing parameter S for easier removal of a larger surface area openable lid section 122**.

The various container embodiments of this invention may be filled and sealed in the following manner. A predetermined volume of food product is placed in the container to a level coincident with or slightly below the surface of container flange 16 (116). A previously formed lid is then positioned over the filled container before it is evacuated and/or flushed with an inert gas, such as nitrogen. Following gas flushing, the lid is pushed down or lowered into the mouth or aperture of its corresponding container. (As noted earlier, the lid interiors are dimensioned to fit tightly against the contours of the opposing flanges to each container body.) Should it be desirable to purge all air from a particular container, the lid may be further dimensioned so that the undersurface of inner layer 34 (134) contacts with only food product once the container is tightly sealed and readied for retort.

The easily openable lid of this invention is then sealed to a container body flange by any suitable means depending on the intended end use for said container. On a more preferred basis, lids are substantially induction heat sealed to adjacent container body flanges. With induction heat sealing, the innermost polymer layers of container lid and body blend or merge into one nondistinct layer. Such sealing occurs through even trace amounts of food, lubricants, water or other liquids in the region of sealing perimeter S.

Having described the presently preferred embodiments, it is to be understood that the invention may be otherwise embodied within the scope of the appended claims.

What is claimed is:

1. A container lid made from a laminate material which includes a thick outer thermoplastic layer, a thin intermediate gas barrier layer and a heat-sealable inner coating layer, said lid having a score line that extends only partially through the outer thermoplastic layer to define an openable lid section and having a tab for severing the laminate material along its score line, said tab attached to the openable lid section by a hollow integral rivet formed from the laminate material.

2. A container lid as set forth in claim 1 wherein the outer thermoplastic layer is at least about 8 mils (203 microns) thick; the intermediate layer is less than about 3 mils (76 microns) thick; and the inner coating layer is less than about 1.5 mils (38 microns) thick.

3. A container lid as set forth in claim 2 wherein the outer thermoplastic layer is at least about five times thicker than the intermediate layer.

4. A container lid as set forth in claim 1 which has a residual beneath the score line at least about 3 mils (76 microns) thick.

5. A container lid as set forth in claim 4 wherein the residual is between about 4–8 mils (102–203 microns) thick.

6. A container lid as set forth in claim 4 wherein the tab has a nose end adapted for depressing into the lid to initiate severance of the laminate material along its score line.

7. A container lid as set forth in claim 1 wherein the outer thermoplastic layer consists essentially of polyvinyl chloride (PVC), polycarbonate (PC) or polyethylene terephthalate (PET) and the intermediate layer is selected from aluminum, steel, tin and iron.

8. A container lid as set forth in claim 1 wherein the inner coating layer is selected from an epoxy, polypropylene, polyvinyl chloride, polyester, polyethylene, nylon, combinations thereof and mixtures thereof.

9. A container lid as set forth in claim 1 wherein the score line is substantially mechanically formed adjacent a sealing perimeter of the lid.

10. A container lid as set forth in claim 1 wherein the score line spirals inwardly from a sealing perimeter of the lid.

11. An easily-openable lid for a container body which may be fully or partially removed for providing access to an aperture in the container body, said lid comprising:

(a) a cold-formable laminate member which includes an outer carrier layer of a first thermoplastic material, an intermediate metallic foil layer and a thin inner coating of a second thermoplastic material, said laminate member having a score line which does not exceed about 85% of the total thickness of the outer thermoplastic layer to define an openable lid section substantially corresponding with the aperture in said container body;

(b) means for fracturing the laminate member along its score line; and (c) means for affixing score line fracturing means to the outer carrier and foil layers of the laminate member without piercing the inner coating layer.

12. An easily-openable lid as set forth in claim 11 wherein the outer carrier layer consists essentially of crystallized or uncrystallized polyethylene terephthalate (PET) and the foil layer consists essentially of aluminum.

13. An easily-openable lid as set forth in claim 11 wherein the outer carrier layer consists essentially of polyvinyl chloride (PVC) and the foil layer consists essentially of aluminum.

14. An easily-openable lid as set forth in claim 11 wherein the outer carrier layer consists essentially of polycarbonate (PC) and the foil layer consists essentially of aluminum.

15. An easily-openable lid as set forth in claim 11 wherein the fracturing means comprises a pull tab having at least one pointed nose adjacent the score line.

16. An easily-openable lid as set forth in claim 15 wherein the pull tab has an aperture through which a hollow rivet extends, said rivet integrally-formed from the laminate member.

17. An easily-openable lid for a food container comprises:

(a) a cold-formable laminate member having an outer thermoplastic layer at least about 8 mils (203 microns) thick, an intermediate metallic foil layer up to about 2 mils (51 microns) thick and a heat-sealable inner coating layer less than about 1 mil (25 microns) thick, said laminate member having a substantially continuous score line that extends only partially through the outer thermoplastic layer to produce a residual at least about 4 mils (102 microns) thick, said score line defining an openable lid section which may be fully or partially removed; and (b) means for fracturing and tearing the laminate member along its score line.

18. An easily-openable lid as set forth in claim 17 wherein the outer thermoplastic layer consists essentially of crystallized or uncrystallized polyethylene terephthalate (PET) and the metallic foil layer consists essentially of aluminum.

19. An easily-openable lid as set forth in claim 17 wherein the laminate member is substantially planar and not offset adjacent both sides of the score line.

20. An easily-openable container capable of withstanding retort sterilization, said container comprising:

(a) a container body having a bottom wall, a plurality of sidewalls extending upwardly from said bottom wall and a flange extending outwardly from the sidewalls opposite said bottom wall;

(b) a laminate lid adapted for heat sealing to the flange of said container body, said lid including a thick outer polymer layer, an intermediate gas barrier layer and a thin, heat-sealable inner coating, said outer polymer layer having a substantially mechanically-induced score line extending only partially therethrough to define an openable lid section; and (c) a pull tab for fracturing and tearing the lid along its score line, said pull tab affixed to the openable lid section through a rivet integrally-formed from the same laminate material as the lid.

21. An easily-openable container as set forth in claim wherein the outer polymer layer of said lid consists essentially of crystallized or uncrystallized polyethylene terephthalate (PET), polyvinyl chloride (PVC), polycarbonate (PC), or mixtures thereof.

22. An easily-openable container as set forth in claim 20 wherein the intermediate gas barrier layer of the lid consists essentially of aluminum.

23. An easily-openable container as set forth in claim 20 wherein the container body includes a stepped region between the sidewalls and the flange; and the lid score line extends over the stepped region to provide substantially total access to the container contents following removal of the openable lid section.

24. In an easily-openable container lid made from a composite material which includes a thick outer thermoplastic layer, an intermediate gas barrier layer and an inner thermoplastic layer for heat-sealing to a container body, the improvement which comprises:

a substantially mechanically-induced score line that extends only partially through the outer thermoplastic layer to define an openable section of the container lid, said lid having a residual area beneath the score line at least about 4 mils (102 microns) thick.

25. In an easily-openable container lid made from a composite material which includes an outer carrier layer of thermoplastic that has been scored to define an openable section of said lid, an intermediate metallic foil layer and an inner thermoplastic layer for heat-sealing to a container body, the improvement which comprises:

a pull tab attached to the openable lid section by a hollow, integral rivet cold-formed from the same composite material as the container lid.

* * * * *